US005261464A

United States Patent [19]

Lorenzo et al.

[11] Patent Number: 5,261,464

[45] Date of Patent: Nov. 16, 1993

[54] OPEN EYELET HEDDLE SYSTEM FOR SHEDDING WARP THREADS

[75] Inventors: Migliorini P. Lorenzo, Terranuova; Molta Giancarlo, Prato; Torelli Giorgio, Pisa, all of Italy

[73] Assignee: Tecnotessile Centro Ricerche S.r.l., Florence, Italy

[21] Appl. No.: 950,446

[22] Filed: Sep. 23, 1992

[30] Foreign Application Priority Data

Sep. 24, 1991 [IT] Italy ..... FI91 A 000236

[51] Int. Cl.[5] ..... D03C 9/02

[52] U.S. Cl. ..... 139/93; 139/11; 139/55.1; 139/430

[58] Field of Search ..... 139/53, 94, 16, 93, 139/51, 52, 38, 11, 431, 383 AA, 55.1, 383 B, 22, 19, 29, 57, 58, 59, 434, 453, 430; 28/203.1, 204–208, 212, 211, 141; 112/80.23, 80.43, 286

[56] References Cited

U.S. PATENT DOCUMENTS 1,776,102 9/1930 Brooks ..... 139/53
5,025,739 6/1991 Inoue ..... 112/286

FOREIGN PATENT DOCUMENTS 0450120 10/1991 European Pat. Off. ..... 139/22
3-069626 3/1991 Japan ..... 139/11

*Primary Examiner*—Andrew M. Falik
*Attorney, Agent, or Firm*—McGlew and Tuttle

[57] ABSTRACT

In order to control the warp shedding motion, on weave looms and similar textile machines, a plurality of flexible and elastic heddles are utilized. The heddles are formed with an open eyelet (1) and are driven within support elements (3). They are vertically slidable in corresponding rigid guides (2) so as to achieve the opening or respectively the closing of the eyelet, according to the relative position of the heddle (1) with respect to the guide. A monofilament element or rod (50) is used for driving the respective heddles.

6 Claims, 5 Drawing Sheets

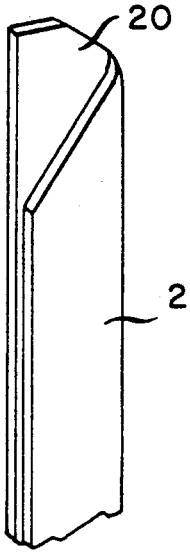
FIG. 4
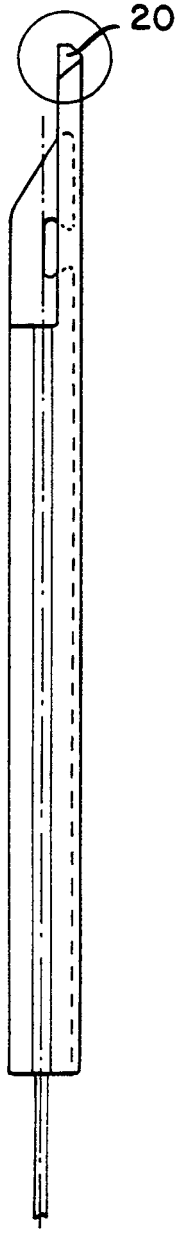
FIG. 2C
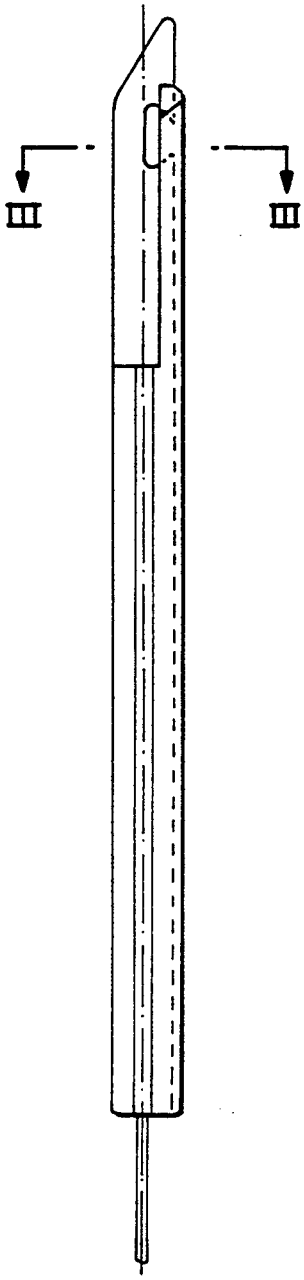
FIG. 2B
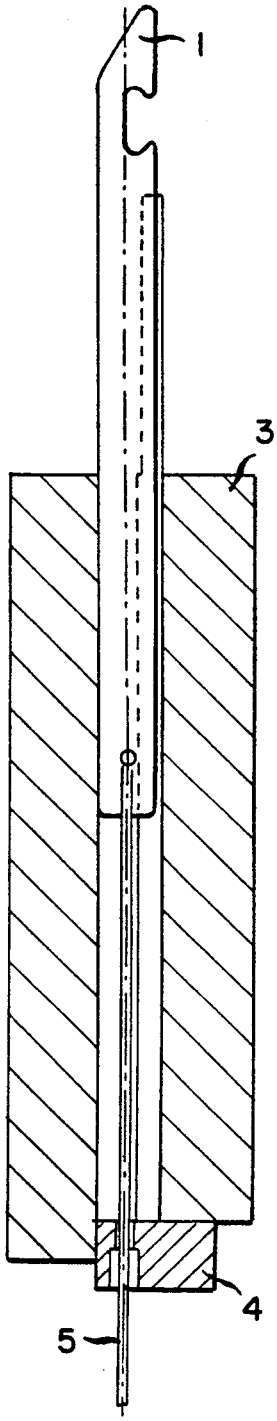
FIG. 2A
FIG. 3
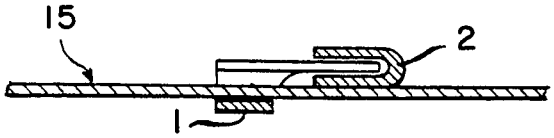

OPEN EYELET HEDDLE SYSTEM FOR SHEDDING WARP THREADS

OBJECT OF THE INVENTION

The object of the present invention is to provide an apparatus for driving or shedding the warp threads for use in weave looms and similar textile machines.

BACKGROUND OF THE INVENTION

It is known to those skilled in the art that, in the conventionally operated weave machines, the control of the warp thread motion—to allow for the passage of the weft thread and for the consequent interweaving—is accomplished through an arrangement of heddles in the closed eyelet of which the warp threads are made to pass.

The insertion of the warp threads, unreeling from the beam, into the eyelets of the heddles and the moving thereof according to the interweaving to be obtained, require times far from short, and limit the interweaving capability of the weave machine.

SUMMARY OF THE INVENTION

The apparatus of the present invention seeks to overcome these drawbacks and achieve the following goals: to utilize the warp according to the traditional beam-operated system, even when directly disposed thread-by-thread on the weave machine or similar, and to non-conventional weaving procedures as well; to simplify and reduce the time for setting up the loom by automating the operations for passing the threads into the individual heddles, and increase the versatility and interweaving capability of the weave machine with respect to the traditional heddles arrangement.

This result has been achieved, according to the invention, by providing an apparatus which comprises a plurality of flexible and elastic heddles with open eyelet, said heddles being independent of each other, housed within support elements and vertically sliding in corresponding rigid and steady guides so as to achieve—according to the relative position of the heddle with respect to the guide—the opening or, respectively, the closing of the eyelet; —means for operating the relevant heddle.

The advantages obtained from the invention lie essentially in that it is possible to operate the insertion of the warp thread into the open eyelet of the heddle in a safe and reliable manner with significant saving of time as compared to the traditional system of inserting the warp threads into closed eyelet-heddles; that it is possible to operate both with warp threads collected on the beam according to the traditional weaving system, and with the warp disposed directly on the weave machine or similar according to non conventional procedures; that it is possible to drive the heddles so as to simultaneously close the eyelet and cause them to take up a working position; that the small dimensions of the guide-heddle assembly and its supports as well as the flexibility of the drive parts thereof, allow the apparatus to be used also with chains of warp having high threads density.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein:

FIGS. 2A–2B–2C represent three positions taken up by a heddle within the relevant guide of the apparatus of FIG. 1;

FIG. 3 shows the section taken on line III—IIIA in FIG. 2B;

FIG. 4 shows the detail of the upper end of a guide of the apparatus of FIG. 1;

DETAILED DESCRIPTION OF THE PREFERRED EMBODIMENT

Figure 1:
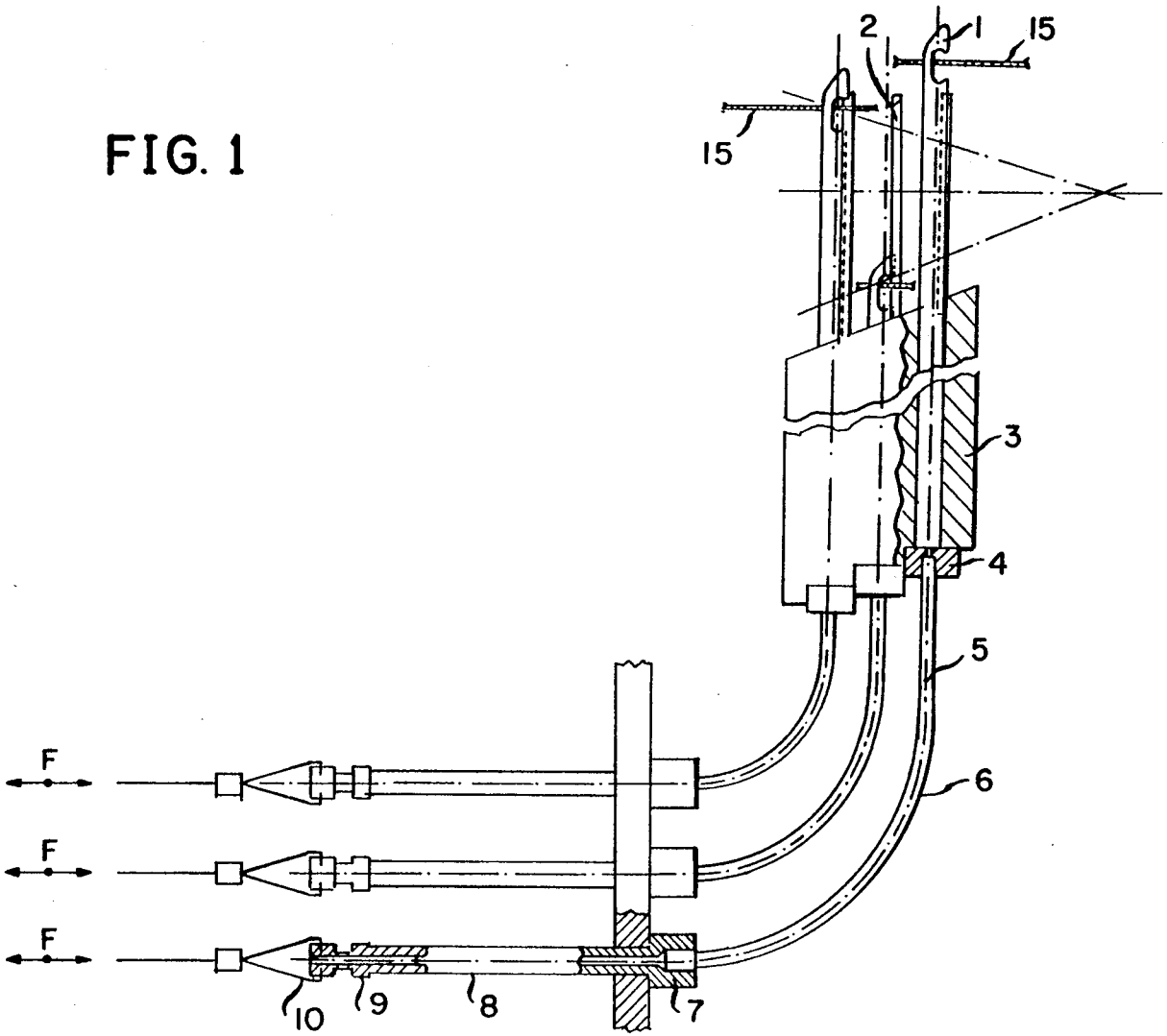
FIG. 1 is a schematic view partly in section of an apparatus according to the invention, with heddle driving means consisting of rigid monofilaments (single wires) sliding within flexible sheaths.
Figure 6:
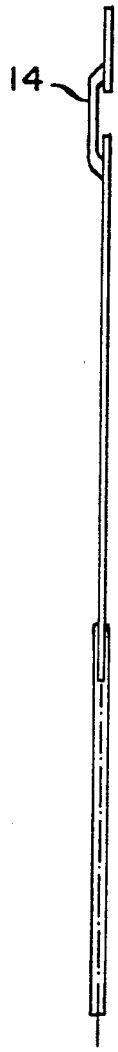
FIG. 6 shows the side view of the heddle of FIG. 5A.

With reference to FIG. 1 of the attached drawings, an apparatus for driving the warp threads 15, according to the invention, comprises:

a plurality of open-eyelet heddles, actuatable independently of each other, free on top and sliding vertically within a corresponding guide 2 housed in a support element 3;

a plurality of rigid monofilaments 5 each of which connected to the respective heddle 1, sliding inside a flexible sheath 6 fitted to the support element 3 by a connecting block 4;

a plurality of clamp means 10, one end of each clamp intended to be fastened to the respective monofilament 5 and going through a respective bush 9 which is maintained in tension by a spring 8 having also the function of recalling or restoring the monofilament 5 and the relevant heddle 1;

means for operating the clamps 10 in the directions indicated by the arrows in FIG. 1.

Figure 9:
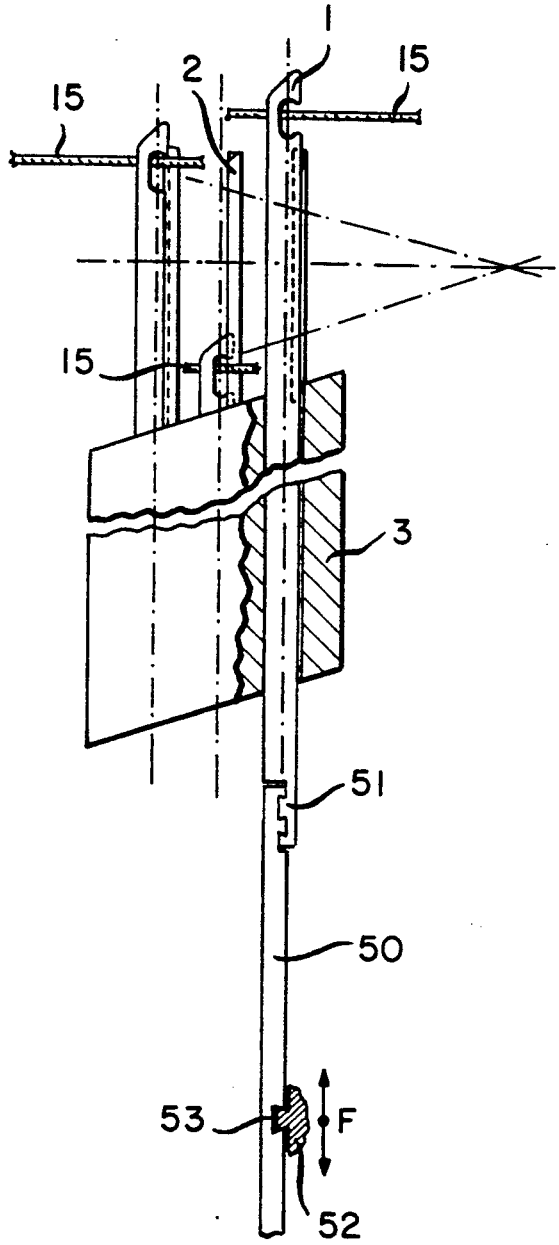
FIG. 9 shows the detail of an alternative embodiment of the heddle-driving means.

As an alternative to the above monofilaments 5, provision is made, according to the invention and with reference to FIG. 9 of the attached drawings, for using rods 50 made of steel sheet.

Each strip 1 is secured to the corresponding rod 50 through a dovetail attachment 51.

A member 52 provided with reciprocating motion in the direction of arrow F, transmits the motion to rod 50, upon a command from the shed-forming member, by means of a dent 53 engaged into a corresponding slot formed in the same rod.

Figure 5A:
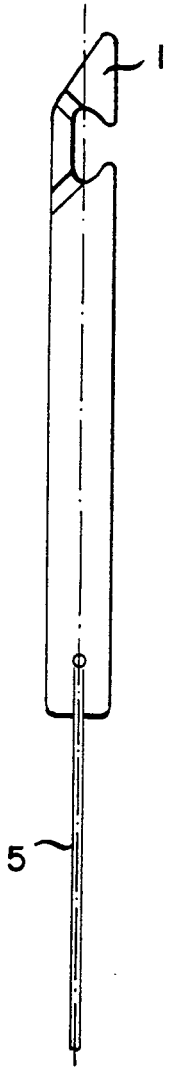
FIGS. 5A–5B–5C show the front view of three possible forms of heddle for the apparatus of FIG. 1.
Figure 5B:
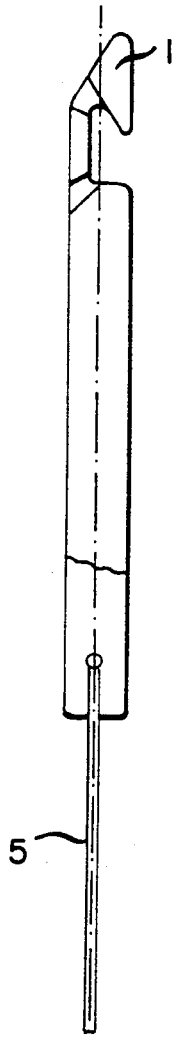
Figure 5C:
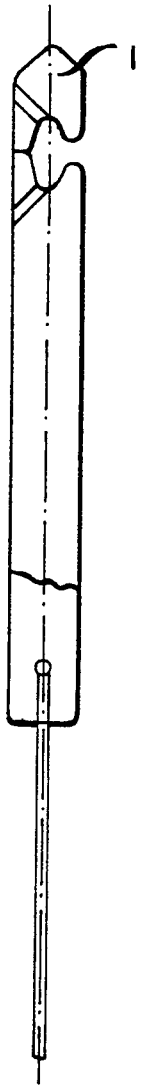
Figure 8:
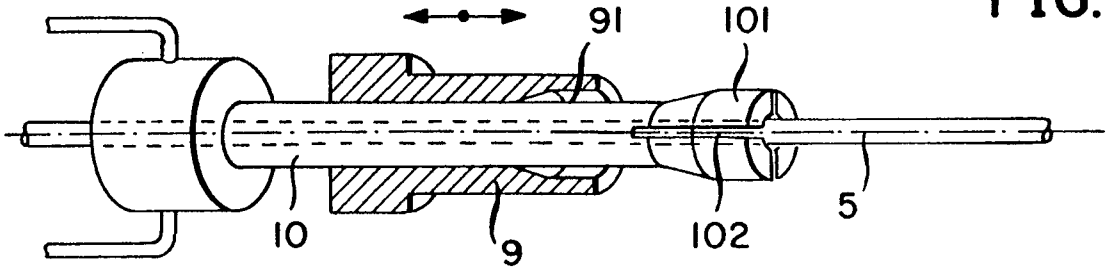
FIG. 8 shows the detail, partly in section, of the clamp-bush pair of the driving means of FIG. 6.
Figure 7:
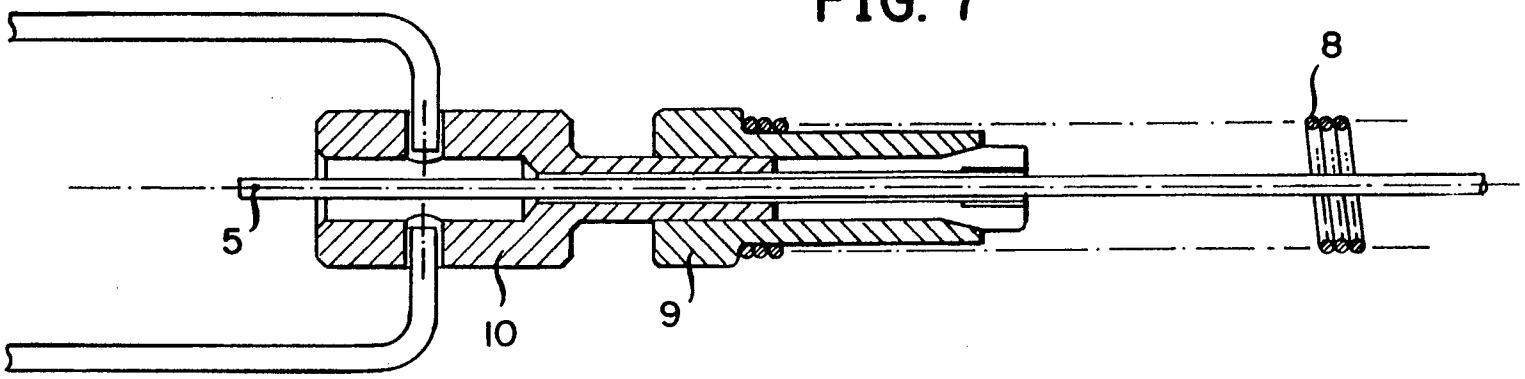
FIG. 7 shows the detail of the monofilament-moving means of the apparatus of FIG. 1.

FIGS. 5A–5B–5C of the attached drawings show some exemplary, not limiting embodiments of the heddle 1 made from a steel band or strip of small thickness which makes it flexible and elastic, said heddle being also provided with an open eyelet of various shapes and dimensions, and with the back 14 forming the closed part of the eyelet being laterally deviated from the heddle plane so as to allow the passage of a thread 15 without having to divert the latter from its axis.

Advantageously, according to the invention, the guides head 20, which has a squeezed C-shape section, exhibits a chamfer on either side of the legs and in opposite direction to one another, while the tip of the emerging leg is trasversally truncated so as to avoid any blocking or tearing of the thread 15 when this is drawn downwards by the heddle 1.

Moreover, said clamp 10 sliding inside the bush 9 has its free end 101 of truncated cone shape and is made elastic by diametral milling cuts 102 so as to provide a removably steady connection of the monofilament 5, which is made to pass therethrough by the clamp forcedly moved into the corresponding conical seat 91 of bush 9.

The quick blockage of the monofilament 5 with respect to clamp 10, without using mechanical tools, allows the lift position of the heddle 1, and the force by which the spring 8 recalls or restores the same heddle in the preset lift position, to be adjusted.

The operation is as follows. The driving rigid monofilament 5, after being released by the member (Jacquard, dobbie, blade device, etc.) provided for the formation of the shed associated thereto, causes the heddle 1 to slide inside the opposite guide 2 and reach the lift position (FIG. 2A) with its eyelet being opened and thus able to receive a warp thread 15.

After the insertion of the thread into the eyelet, the heddle 1 is called back downwards by the draw exerted by the shed-forming member, and the thread 15 is blocked within the heddle eyelet which closes against the guide 2.

The heddle 1, with the thread inserted into its eyelet, may now be driven into a reciprocating up-and-down motion, according to the commands given by the shed-forming member, thus taking up a work position with a path corresponding, in part or in all, to the length of the guide 2 (FIGS. 2B or 2C).

The rigid and fixed guide 2 is formed by C-bending or milling a sheet of steel and is intended to carry out the following functions: keeping the rigid monofilament 5, which drives the heddle 1, within the guides during its forward and backward travel; maintaining the heddle 1 rigidly in place when this is at its maximum lift position (FIG. 2A); closing the eyelet of heddle 1, thereby allowing the thread 15 passing through the eyelet to be moved to the work positions at different levels (FIGS. 2B and 2C).

Practically, all the construction details may vary in any equivalent way as far as the form, dimensions, elements disposition, nature of the used materials are concerned, without nevertheless departing from the scope of the adopted solution idea and, thereby, remaining within the limits of the protection granted to the present patent for industrial invention.

We claim:

1. Apparatus for driving warp threads, for forming a shed in textile machines, comprising:

a plurality of flexible and elastic heddles, each heedle having an eyelet for insertion of a warp thread therethrough; a support element; a rigid guide, each of said heddles being housed within a corresponding support element and vertically sliding in the corresponding said rigid guide to achieve an opening or closing of said eyelet according to a relative position of the heddles with respect to said rigid guide, and drive means for vertically driving each of said heddles independently.

2. An apparatus according to claim 1, wherein said drive means is formed by rigid monofilament elements sliding within flexible sheaths, each of said monofilament elements having a corresponding clamp and passing through a bush provided with a return spring, said clamp being removably fixed at a free end of a corresponding one of said monofilaments, and being engaged with draw means for programmed positioning of said heedles in a lifted position, with open eyelet, and in a working position, at different levels, and in a lowered position, with the eyelet being closed.

3. An apparatus according to claim 2, wherein said driving means includes a plurality of rods, each rod corresponding to one of said heddles, said rods being fixed to said heddles through a dovetail attachment and are engaged to draw means for positioning said heddles in response to a programmed command to be disposed, in a lifted position with open eyelet, in a working position, at different levels, and in a lowered position, with the eyelet being closed.

4. An apparatus according to claim 2, wherein each of said heddles is formed of steel sheet elements of a thickness which is much smaller than a width; each of said heddles having a back forming a closed part of the eyelet, said back deviating laterally from a heedle plane, thereby allowing said warp thread inserted within the eyelet to avoid undergoing any deviation with respect to its own axis, during lowering of the heddle.

5. An apparatus according to claim 2, wherein each of said rigid guides has a flattened C-section with a head portion chamfered in an opposite direction in each of two legs forming said rigid guide, and said rigid guide having an emerging leg with an end transversely truncated thereby avoiding blocking or tearing of thread passing through the eyelet when it is drawn downwards by the heddle.

6. An apparatus according to claim 3, wherein each clamp has a free end of truncated cone shape with diametral milling cuts to provide flexibility and allow for blocking the monofilament in a desired working position by forcing said conical end into a corresponding conical seat formed in the bush.

* * * * *